United States Patent [19]

Stroezel

[11] 3,943,669

[45] Mar. 16, 1976

[54] GYRATORY SANDER

[76] Inventor: Reinhold Stroezel, Im Waldle 9, 7022 Leinfelden-Oberaichen, Germany

[22] Filed: May 8, 1974

[21] Appl. No.: 468,136

[30] Foreign Application Priority Data

May 9, 1973 Germany ..... 2323270

[52] U.S. Cl. ..... 51/170 MT

[51] Int. Cl.[2] ..... B24B 23/04

[58] Field of Search ..... 51/170 R, 170 MT, 170 T, 51/170 TL; 173/163; 418/61 A; 415/503; 123/8.45

[56] References Cited

UNITED STATES PATENTS

| | | | |
|---|---|---|---|
| 2,334,172 | 11/1943 | Champayne | 51/170 MT |
| 2,367,668 | 1/1945 | Champayne | 51/170 MT |
| 3,043,274 | 7/1962 | Quackenbush | 173/163 |
| 3,426,525 | 2/1969 | Rubin | 418/61 A UX |
| 3,452,643 | 7/1969 | Pratt | 418/61 A |
| 3,555,743 | 1/1971 | Geiger | 51/170 MT |
| 3,762,842 | 10/1973 | George | 418/61 A |

*Primary Examiner*—Donald G. Kelly

[57] ABSTRACT

A sanding plate is mounted in a housing with freedom of gyratory motion, and a rotatable eccentric shaft is journalled in the housing and connected with the plate for imparting the motion to the latter. A pneumatically powered rotary piston engine is mounted in the housing and connected with the shaft for rotating the same. The rotary piston of this engine has an imbalance which compensates for the imbalance resulting from the motion of the plate.

12 Claims, 5 Drawing Figures

GYRATORY SANDER

BACKGROUND OF THE INVENTION

The presents invention relates generally to a sander, and more particularly to a power-driven sander. Still more specifically, the invention relates to a gyratory sander which is driven by a fluid motor.

Motor-driven gyratory sanders are well known, having a housing, a drive arrangement and a sanding plate which has gyratory motion imparted to it by the drive arrangement and which carries in operation the abrasive sandpaper or the like. The known constructions of this type use an electromotor which is mounted in the housing and which drives the sanding plate via an eccentric shaft. Electromotors of the type required for such applications are relatively heavy and certainly expensive, and they are also relatively large and are not easy to accommodate in the housing if it is desired to maintain the housing small. Moreover, it is a particular disadvantage of these prior-art constructions that they require special weights to balance the gyratory mass of the plate, in order to eliminate unpleasant vibrations and difficult control over the sander.

SUMMARY OF THE INVENTION

It is, accordingly, a general object of the present invention to provide an improved gyratory sander which avoids the aforementioned disadvantages.

More particularly, it is an object of the invention to provide such an improved gyratory sander which is simple and inexpensive to construct.

An additional object of the invention is to provide such a gyratory sander in which the drive is very small in its dimensions, and therefore the overall sander can be correspondingly small.

An additional object of the invention is to provide such a gyratory sander which does not require special weights or masses to compensate for the imbalance produced by the gyratory motion of the sanding plate.

In keeping with the above objects, and with others which will become apparent hereafter, one feature of the invention resides, in a gyratory sander, in a combination comprising a housing and a sanding plate mounted on the housing with freedom of gyratory motion. A rotatable eccentric shaft is journalled in the housing and connected with the plate for imparting the gyratory motion to the latter. A pneumatically powered rotary piston engine is mounted in the housing and is connected with the shaft for rotating the same; the engine has a rotary piston having an imbalance which compensates for the imbalances resulting from the gyratory motion of the plate.

The gyratory sander according to the present invention has various important advantages over those of the prior art. Since its fluid-powered rotary piston engine can be very small, the overall size of the sander can similarly be small, and its weight can be low, making it easy to handle. The piston can be located closely adjacent to the sanding plate, thus providing for excellent balancing of the apparatus.

The need for a special compensating or balancing weight to compensate for the imbalances resulting from the gyratory motion of the sanding plate, is completely avoided, and it is the imbalance of the piston of the piston engine — which piston is not balanced on purpose — which provides such compensation.

The construction according to the present invention is inexpensive to produce and can therefore be sold at lesser cost than the prior-art constructions.

The rotary piston engine drive requires next to no maintenance and cannot be damaged if subject to excessive loads, as may be the case when such a sander is used by an amateur. If the inner circumferential surface bounding the piston chamber, and the outer surface of the piston itself are manufactured with sufficient precision, sealing strips which are otherwise required at the corners of such rotary pistons can be eliminated, and this makes it possible to operate the engine with compressed air which need not have oil admixed with it, so that the device can, for instance, be used in applications where the presence of oil that is being discharged in a fine vapor with the discharged pneumatic fluid would be harmful, for instance, in lacquering of furniture. It is well known that normally a rotary piston engine which is fluid powered requires a certain amount of oil in the compressed fluid in order to lubricate the moving parts, but this is not necessary in the construction according to the present invention.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
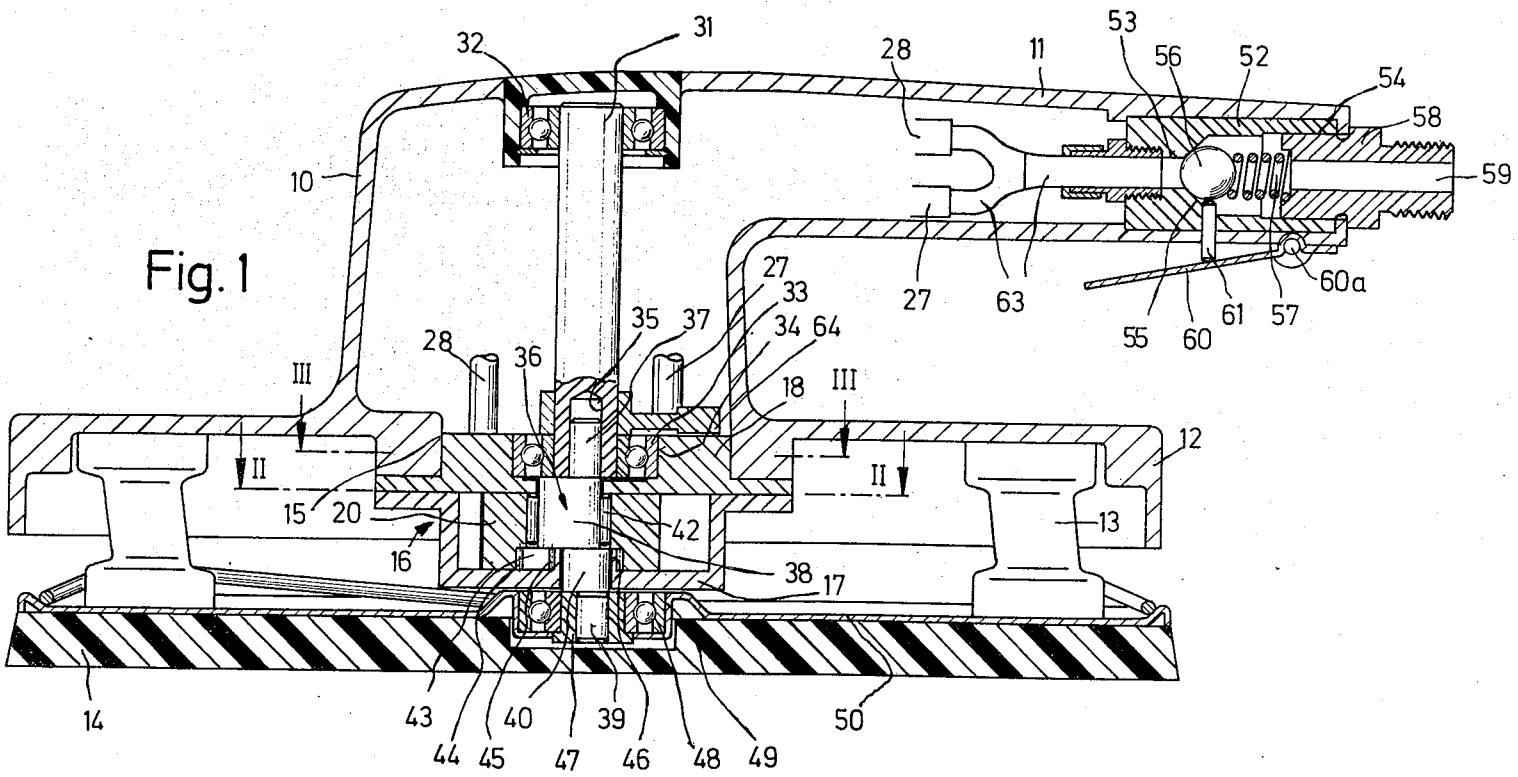
FIG. 1 is a longitudinal vertical section through a sander according to the present invention.
Figure 2:
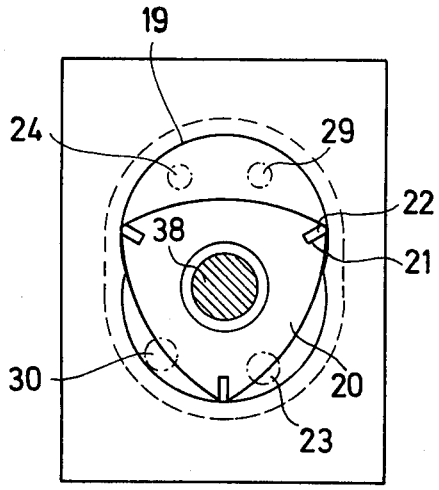
FIG. 2 is a section taken on line II—II of FIG. 1.

Referring now in detail to the single embodiment shown in FIGS. 1–5, it will be seen that the gyratory sander therein illustrated has a housing 10 which is provided or formed with a handle 11 and an approximately rectangular base portion 12. The base portion 12 is connected with the sanding plate 14 by means of a plurality of rubber springs 13. Mounted in the base portion 12, or rather in a recess 15 thereof, is a pneumatically powered (especially compressed-air powered) rotary piston engine 16 which imparts gyratory motion to the sanding plate 14.

Rotary piston engines are already well known in the art, having first become known as rotary internal combustion engines of the type which is for instance disclosed in U.S. Pat. No. 2,988,065. The principle of operation of a pneumatically-powered rotary piston engine is somewhat different from that disclosed in the aforementioned U.S. patent, but the basic concept of having a housing provided with a rotor chamber having essentially the profile of a multi-lobed epitrochoid, and a more or less triangular rotor body accommodated in this chamber, is clearly shown in that patent and is applicable also to pneumatically-powered rotary piston engines.

The engine used in the construction according to the present invention has a housing 17 and open side of which is closed by a cover 18. The housing 17 is formed with an epitrochoidal chamber 19 in which there is mounted for rotation an essentially triangular rotary piston 20 which is formed at each of its corners with a slot 21 extending in axial direction and accommodating a sealing strip 22, for instance of rubber or synthetic plastic material, which slides in sealing engagement over the inner circumferential surface bounding the chamber 19.

Figure 3:
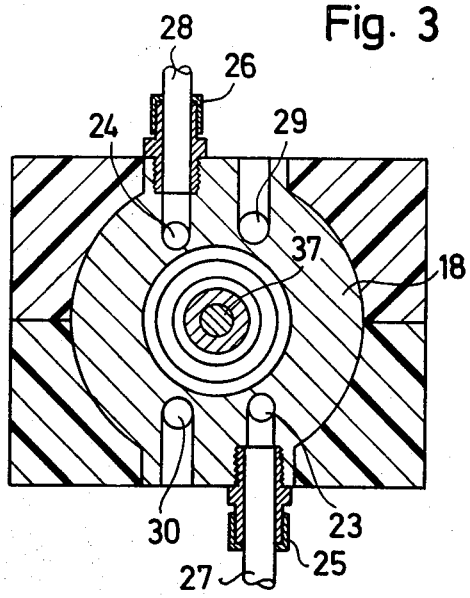
FIG. 3 is a section taken on line III—III of FIG. 1.
Figure 4:
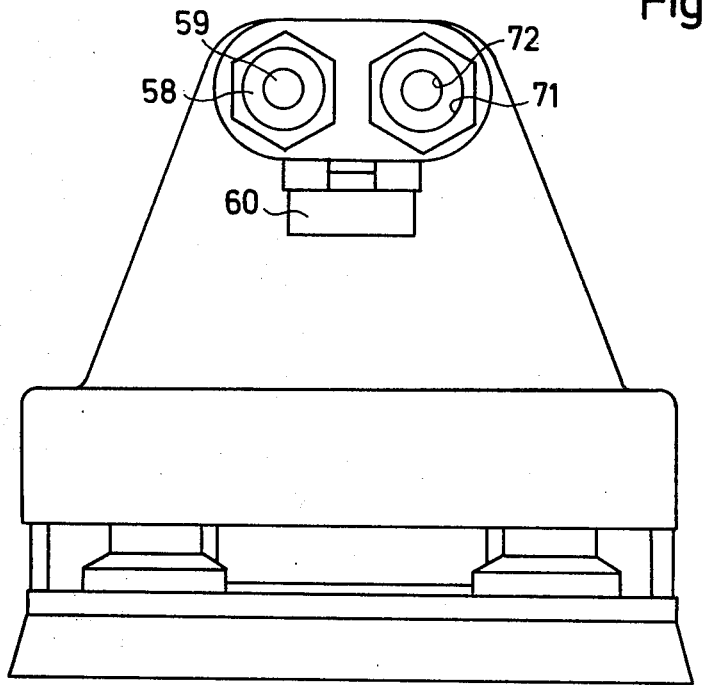
FIG. 4 is an end view of FIG. 1, looking towards the left.

The cover 18 is provided with two diametrically opposite inlet openings 23 and 24, as shown in FIG. 3. Each of these openings is provided with a nipple 25 and 26, respectively, and each of these, in turn, is in communication with a supply hose or conduit 27, 28. In addition to the inlet openings 23, 24, the cover 18 is formed with a pair of outlet openings 29 and 30 which are also each provided with a conduit, the latter, however, not being shown. It will be noted that one inlet opening and one outlet opening are always located adjacent one another, near the ends of the longitudinal axis of the epitrochoidal chamber 19. The purpose of this arrangement will be discussed subsequently.

An eccentric shaft 31 is journalled by means of a ball bearing 32 in the upper part of the housing 10, and it is journalled by means of a ball bearing 33 in an opening 34 of the cover 18. This eccentric shaft 31 is driven by the solid cross section rotary piston 20. The shaft 31 is formed with a blind bore 35 into which the actual eccentric portion 36 is press-fitted, for which the portion 36 is provided with a pin-like projection 37 which is received in the bore 35. The portion 36 is formed with an eccentric cam surface 38 and an eccentric pin 39, which are separated from one another by a concentric intermediate portion 40. It should be noted that the portions 38 and 39 are eccentric with reference to the center axis of the shaft 31 in mutually opposite directions. The piston 20 is journalled on the cam surface 38 by means of a needle bearing 42 and is provided at its underside (the downwardly facing side in FIG. 1) with a concentric recess 43 bounded by an inner annulus of teeth 44. These teeth mesh with an annulus of external teeth 45 which is formed on a stub shaft 46 that extends into the recess 43 and around which the piston 20 orbits.

A ball bearing 48 is mounted on a sleeve 47 which in turn is fixedly mounted on the eccentric pin 39. A collar 49 surrounds an opening of a member 50 forms an opening in which the ball bearing 48 is accommodated; the member 50 is rigidly connected with the sanding plate 14.

FIG. 1 shows that an insert 52 is mounted in the handle 11 of the housing 10 and formed with a stepped bore having the portions 53 and 54 which define with one another an inclined shoulder 55; the latter serves as a seat for a ball-shaped valve member 56 which is pressed against this seat by a spring 57. The spring 57 bears upon the valve member 56 on the one hand, and upon a connecting nipple 58 which is threaded into the insert 52 on the other hand. The nipple 58 has a central bore 59 which is connected with a source of compressed air or other compressed gaseous fluid via a hose that is not illustrated. The valve member 59 can be lifted off its valve seat 55 by a pin 61 which is carried on a lever 60, the latter being pivoted to the handle 11 at 60a. When the lever 60 is operated, that is when it is pushed upwardly in FIG. 1, the valve member 56 is urged away from the seat 55, so that compressed air can pass from the bore 59 into the Y-shaped connector 63 which, in turn, supplies compressed air into the fragmentarily shown conduits 27, 28 (for instance, hoses of rubber or synthetic plastic material) which communicate with the inlets 23 and 24, respectively.

Figure 5:
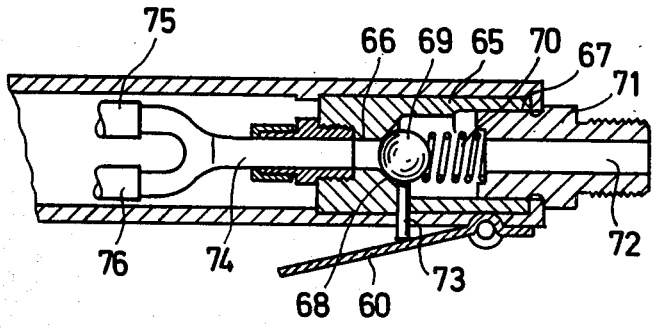
FIG. 5 is a fragmentary sectional view showing a detail of the handle of the device in FIG. 1.

Laterally adjacent the insert 52 in the handle 11 is another arrangement which discharges the spent compressed air that is returned from the rotary piston engine 16. The relative position of this arrangement with reference to the insert 52 is shown in the end view illustrated in FIG. 4, and details of the arrangement are shown in FIG. 5. It will be seen that the second arrangement has an insert 65 which is also mounted in the handle 11 laterally adjacent the insert 52 and which is formed with a stepped bore 66, 67 which define between one another an inclined shoulder 68 that serves as a seat for a second spherical valve member 69. The latter is pressed against the seat 68 by a spring 70 which bears upon the outlet nipple 71 that is threaded into the insert 65. The central bore 72 of the outlet nipple 71 is connected with a hose (not illustrated) which discharges spent pneumatic fluid to the ambient atmosphere. Conceivably, the hose might be omitted. The valve member 69 can be urged away from its seat 66 by a pin 73 which is also carried by the lever 60. Thus, when the lever 60 is moved upwardly to open the valve member 56 of FIG. 1 and thus admit compressed fluid, the valve member 69 is simultaneously opened to permit the escape of spent compressed fluid. The valve seat communicates with a Y-shaped connector 74 which has two branches that are connected via respective conduits 75 and 76, for instance again hoses of rubber or synthetic plastic material, with outlets 29 and 30.

When the lever 60 is operated to admit compressed fluid via the inlet bore 59, this compressed fluid is admitted into the chamber 19 via the inlets 23 and 24, causing the piston 20 to rotate, and to orbit about the stub shaft 46. Since the teeth 44 of the piston 20 mesh with the teeth 45 of the stub shaft 46, the piston 20 causes the eccentric shaft 31 to turn in rotation via the cam surface 38. This, in turn, results in the transmittal of an oscillatory movement to the eccentric pin 39 which is transmitted via the ball bearing 48 to the sanding plate 14 so that the latter now performs a gyratory movement.

As is well known, the movement of the plate 14 will result in an imbalance which would normally be felt unpleasantly by a user, unless compensated for by means of special weights and arrangements. According to the present invention, the need for such compensating arrangements is completely avoided since the compensation is effected by the piston 20 itself, which has purposely not been balanced as is otherwise the case in conventional rotary piston engines. Due to this purposeful imbalance of the piston 20, the latter produces an imbalance as it rotates, and this imbalance is so directed— as a result of the positioning of the parts 38 and 39— that it precisely counteracts the imbalance produced by the gyratory motion of the sanding plate 14. This, then, makes it possible to eliminate special weights and other arrangements which are required in prior-art sanders to obtain a compensation of the imbalance.

If desired, a separate balance weight 64 may be mounted on the eccentric shaft 31, but this is not really required. If such a balance weight 64 is in fact provided, then it should be noted — that this specially emphasized — that it will serve only to balance tilting forces, that is to obtain an ideal balance, but that it is not needed to provide for a compensation of the imbalance created by the gyratory motion of the sanding plate 14. Such balancing is obtained exclusively by the use of the imbalanced rotary piston 20.

The relationship of the inlet and outlet openings for fluid on the cover 18 has been mentioned before. The purpose of arranging them in the manner described is to assure that one side face of the rotary piston 20 will always be fully subjected to the pressure of the compressed gaseous fluid. The arrangement assures that while one of the inlet openings is still open, the next one will already also be opened by the rotating piston, so that the latter is always subjected to fluid pressure. As soon as the piston opens one of the outlet openings, the spent pressure fluid can flow out through this outlet opening.

Sealing strips 22 have been illustrated and described. However, as already mentioned eariler, it is possible to dispense with these if the piston 20 and the epitrochoidal chamber 19 are produced to precise tolerances, in which case there is no need to admit any oil into the compressed air, since no lubricating effect is then required. If, however, sealing strips 22 are present, then oil in small quantities must be admitted with the air to prevent premature wearing of the strips 22.

The embodiment which has been illustrated uses a two-lobed epitrochoidal chamber 19, and a three-cornered rotary piston. It is known that this results in an rpm ratio between the rotary piston 20 and the output of 2:3. If an rpm ratio of 3:4 is desired, then the epitrochoidal chamber would have to have three lobes and the piston would again have to be three cornered. In such an embodiment, an additional inlet opening and an additional outlet opening would have to be provided and associated with the third lobe. Three-lobed epitrochoidal chambers in rotary piston engines are already known. Except for this variation, such an embodiment would correspond to the one illustrated in FIGS. 1–5.

It will be understood that each of the elements described above, or two or more together, may also find a useful application in other types of constructions differing from the type described above.

While the invention has been illustrated and described as embodied in a gyratory sander, it is not intended to be limited to the details shown since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

I claim:

1. A gyratory sander, comprising a housing; a sanding plate mounted on said housing with freedom of gyratory motion; a rotatable eccentric shaft journalled in said housing and connected with said plate for imparting said motion to the latter; and a pneumatically powered rotary piston engine mounted in said housing and connected with said shaft for rotating the same, said engine having a casing formed with a chamber which has the shape of a multi-lobed epitrochoid, and a rotary piston rotatably mounted in said chamber and having apex portions which are in sealing engagement with an inner circumferential surface bounding said chamber, said rotary piston of said engine having an imbalance which compensates for imbalances resulting from said motion of said plate.

2. A sander as defined in claim 1, wherein said rotary piston is of solid cross section.

3. A sander as defined in claim 1, said casing being further formed with a pair of opposite inlet openings and with a pair of opposite outlet openings, all of which communicate with said chamber.

4. A sander as defined in claim 3, wherein one each of said inlet and outlet openings are located adjacent one another and in one of said lobes, and the other inlet and outlet openings are also located adjacent one another and in the other of said lobes.

5. A sander as defined in claim 3, wherein said chamber has an open end, and said casing includes a cover covering said open end and being provided with said inlet and outlet openings.

6. A sander as defined in claim 1, and further comprising a balance weight mounted on said shaft and serving solely for counteracting tilting forces which develop in operation of said sander.

7. A sander as defined in claim 1, said housing having a handgrip portion; further comprising valve means mounted on said handgrip portion and operative for controlling the admission of pneumatic fluid to said engine; and manually operable means for opening and closing said valve means.

8. A sander as defined in claim 3, wherein said chamber has three lobes.

9. A sander as defined in claim 1, wherein said piston has apex portions which exceed said lobes by one; and further comprising sealing means on said apex portions in sealing contact with an inner circumferential surface bounding said chamber.

10. A gyratory sander, comprising a housing; a sanding plate mounted on said housing with freedom of gyratory movement; a pneumatically powered rotary piston engine mounted in said housing and including a casing, and a rotary piston accommodated in said casing and having an imbalance which compensates for imbalances resulting said movement of said plate; a rotatable shaft journalled in said housing and said casing and extending through the latter, said shaft being connected with said plate for imparting said movement thereto and having an eccentric shaft portion on which said piston is journalled; and cooperating annuli of gear teeth on said piston and said casing for effecting rotation of one in response to rotation of the other.

11. A sander as defined in claim 10, wherein said piston is formed with an axial recess, and one of said annuli is an annulus of internal gear teeth in said recess, said casing having a portion extending into said recess and being exteriorly formed with the other of said annuli of gear teeth.

12. A sander as defined in claim 10, said shaft having an additional eccentric shaft portion which is eccentric in a direction opposite to the eccentricity of the first-mentioned shaft portion; and further comprising an anti-friction bearing on said plate and journalling said additional eccentric shaft portion.

* * * * *